US011098501B2

(12) United States Patent
Ramsay

(10) Patent No.: US 11,098,501 B2
(45) Date of Patent: Aug. 24, 2021

(54) HASP WITH CYLINDRICAL LOCK

(71) Applicant: Ronald Ramsay, Corona, CA (US)

(72) Inventor: Ronald Ramsay, Corona, CA (US)

( * ) Notice: Subject to any disclaimer, the term of this patent is extended or adjusted under 35 U.S.C. 154(b) by 328 days.

(21) Appl. No.: 16/351,408

(22) Filed: Mar. 12, 2019

(65) Prior Publication Data

US 2019/0360240 A1 Nov. 28, 2019

Related U.S. Application Data

(60) Provisional application No. 62/675,527, filed on May 23, 2018.

(51) Int. Cl.
*E05B 67/38* (2006.01)
*E05B 67/36* (2006.01)
*E05C 19/08* (2006.01)

(52) U.S. Cl.
CPC ..... *E05B 67/383* (2013.01); *E05B 67/36* (2013.01); *E05C 19/08* (2013.01); *E05Y 2900/106* (2013.01)

(58) Field of Classification Search
CPC ..... E05B 67/383; E05B 67/36; E05B 67/38; E05B 2067/386; E05C 19/08
USPC ..... 70/2, 53–56, 128–130; 292/148, 153
See application file for complete search history.

(56) References Cited

U.S. PATENT DOCUMENTS 3,736,016 A 5/1973 Garvey et al.
3,953,062 A 4/1976 Maston
4,030,321 A 6/1977 Kenyon
4,031,719 A * 6/1977 Klingler ..... E05B 67/38 70/56
4,068,505 A 1/1978 Volk, Jr.
4,095,828 A * 6/1978 East ..... E05B 67/383 292/148
4,372,138 A * 2/1983 De Forrest ..... E05B 67/38 70/168
4,437,692 A 3/1984 Halopoff
4,598,563 A 7/1986 Berkowitz
4,643,469 A * 2/1987 Johnston ..... E05C 5/00 292/148
4,655,487 A 4/1987 Korn et al.
4,877,275 A 10/1989 DeForrest, Sr.
4,884,424 A 10/1989 Meyer
4,911,486 A 3/1990 Anderson
5,127,244 A * 7/1992 Myers ..... E05B 67/36 70/14
5,172,574 A 12/1992 Perfetto
(Continued)

*Primary Examiner* — Lloyd A Gall
(74) *Attorney, Agent, or Firm* — Kirk A. Buhler; Buhler & Associates Patenting

(57) ABSTRACT

Improvements in a hasp are disclosed. The hasp allows for locking the hasp with a cylindrical lock to operate on a door such as, but not limited to, a garage door, a roll-up door or a shed door. This configuration allows for upgrade or replacement of these types of door locks without requiring re-design or replacement of the door. The cylindrical locks offer a greater protection because they can't be "picked" using traditional lock picking tools. This makes the lock safer from people that may try to break into the door. The cylindrical lock fits primarily within the hasp. This prevents a person from grinding through the lock or shackle. The shackle can be configured with just the circular opening for the key visible. It can be further enclosed to prevent infestation from bugs such as hornets that can fill the inside of the hasp with dirt.

20 Claims, 4 Drawing Sheets

(56) References Cited

U.S. PATENT DOCUMENTS

| | | | | |
|---|---|---|---|---|
| 5,287,710 | A | 2/1994 | James | |
| 5,307,653 | A * | 5/1994 | Davis | E05B 67/38 292/148 |
| 5,964,108 | A * | 10/1999 | McBride | E05B 27/086 70/340 |
| 6,351,975 | B1 * | 3/2002 | Valdes | E05B 67/38 292/148 |
| 6,477,872 | B1 * | 11/2002 | Denton, Jr. | E05B 67/36 70/100 |
| 6,494,064 | B1 * | 12/2002 | Pena | E05B 67/38 292/148 |
| 8,297,088 | B1 * | 10/2012 | Zhang | G06F 1/182 70/58 |
| 8,561,440 | B1 | 10/2013 | Sierra | |

* cited by examiner

HASP WITH CYLINDRICAL LOCK

CROSS REFERENCE TO RELATED APPLICATIONS

This application claims the benefit of Provisional Application Ser. No. 62/675,527 filed May 23, 2018 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a hasp style lock. More particularly, the present hasp lock uses a cylindrical lock that passes horizontally through the hasp.

Description of Related Art Including Information Disclosed Under 37 CFR 1.97 and 1.98

Hasp style locks are used in a variety of installations. Most of these locks are used for garage doors, shed doors or for locking roll-up storage units. The hasp style latch is configured with two positions of the hasp. The first position is with a pin stored within the hasp enclosure. In the second position the pin is moved out of the enclosure and into a receiving hole to stop movement of the door. A lock is placed through the hasp to prevent movement of the pin. In prior art hasps, the hasp is designed to accept a common loop type lock that is passed through the hasp.

A number of patents and or publications have been made to address these issues. Exemplary examples of patents and or publication that try to address this/these problem(s) are identified and discussed below.

U.S. Pat. No. 3,953,062 was issued to John F. Maston on Apr. 27, 1976 and is titled Padlock Clasp. This patent discloses a clasp having a rigid back plate with one side projecting outwardly to enclose the latching side of a locking padlock. The other side of the back plate is similarly outwardly turned, and a bolt is slidably and pivotally positioned in aligned holes in the outwardly turned sides. A front plate is welded to the bolt and a bale support member is welded orthogonally to the inside face of the front plate. A matching bale support member is welded to the back plate and when the clasp is closed, the two bale support members are aligned. This patent does not use a cylindrical lock.

U.S. Pat. No. 4,068,505 was issued to Kenneth Q. Volk Jr. on Jan. 17, 1978 and is titled Locking Device. This patent discloses a locking device includes a base having openings therein for joining the base to a first surface, such as the surface of the door, and a cover hinged to the base plate by a solid bar passing through apertures in flanges near the upper end of the base plate and cover. This solid bar is sufficiently long to engage an opening in a second surface, such as a door jamb. Joined to and extending laterally from the solid bar is a second bar that lies between the flanges of the cover plate, thus confining the second bar to the space between them, and preventing removal of the solid bar from the device. This lock is only works with a lock having a shackle that can be easily cut.

U.S. Pat. No. 4,437,692 was issued to David Halopoff on Mar. 20, 1984 and is titled Protective Hasp for Padlock. This patent discloses a back plate serving as a slide bolt frame is designed to be fastened to a door such as a garage door to position a latch bolt slidably mounted on pivot tabs of the back plate. A cover plate has complementary pivot tabs which engage the latch bolt and pivotally mount the cover plate on the back plate. Both plates are also provided with a pair of locking tabs positioned so that one tab of each pair lies adjacent one tab of the other pair for engagement by the shackle of a padlock. In this way, the cover plate is held in an overlying position protecting the padlock. A transverse projection on the latch bolt has a slot engageable with tabs of each pair thereby to lock the latch bolt in either extended or withdrawn position. This hasp will also not accept a cylindrical lock.

U.S. Pat. No. 4,655,487 was issued to Julius A Korn et al., on Apr. 7, 1987 and is titled Garage Door Bolt with Stationary Protective cover. This patent discloses a sliding bolt with stationary safety cover for mounting on a door and for locking with a padlock having a bale portion and including the following structure. A back plate for mounting on the door. An upper pair of flange members extending outwardly from the back plate and with each upper flange member including a first opening. A sliding bolt passing through and guided by the first openings in the upper pair of flange members. A lower pair of flange members extending outwardly from the back plate and with each lower flange member including a second opening for receiving the bale portion of the padlock. A handle and locking member attached to the sliding bolt and including a first upwardly extending portion forming a handle for sliding the bolt within the first openings in the upper pair of flange members and including a second downwardly extending portion located between the lower pair of flange members. This hasp is not configured to accept a cylindrical lock.

What is needed is a hasp type lock where the housing accepts a cylindrical lock. The proposed hasp with cylindrical lock disclosed in this document provides the solution with a hasp that reduced the ability of the lock from being cut through the shackle.

BRIEF SUMMARY OF THE INVENTION

It is an object of the hasp with cylindrical lock to be configured to operate on a door such as, but not limited to, a garage door, a roll-up door or a shed door. This configuration allows for upgrade or replacement of these types of door locks without requiring re-design or replacement of the door.

It is an object of the hasp with cylindrical lock to accept a cylindrical lock. Cylindrical locks offer a greater protection because they can't be "picked" using traditional lock picking tools. This makes the lock safer from people that may try to break into the door.

It is another object of the hasp with cylindrical lock for the cylindrical lock to fit completely within the hasp. This prevents a person from grinding through the lock or shackle. The cylinder lock eliminated the use of bolt cutters that can be quietly cut through the shackle of a padlock. With the cylindrical lock enclosed with the shackle only the circular opening for the key is visible. It can be further enclosed to prevent infestation from bugs such as hornets that can fill the inside of the hasp with dirt.

It is still another object of the hasp with cylindrical lock for the lock to be removable from the hasp. This allows for a quick change of the lock when a new owner uses the hasp or a manager needs to lock the hasp temporarily.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
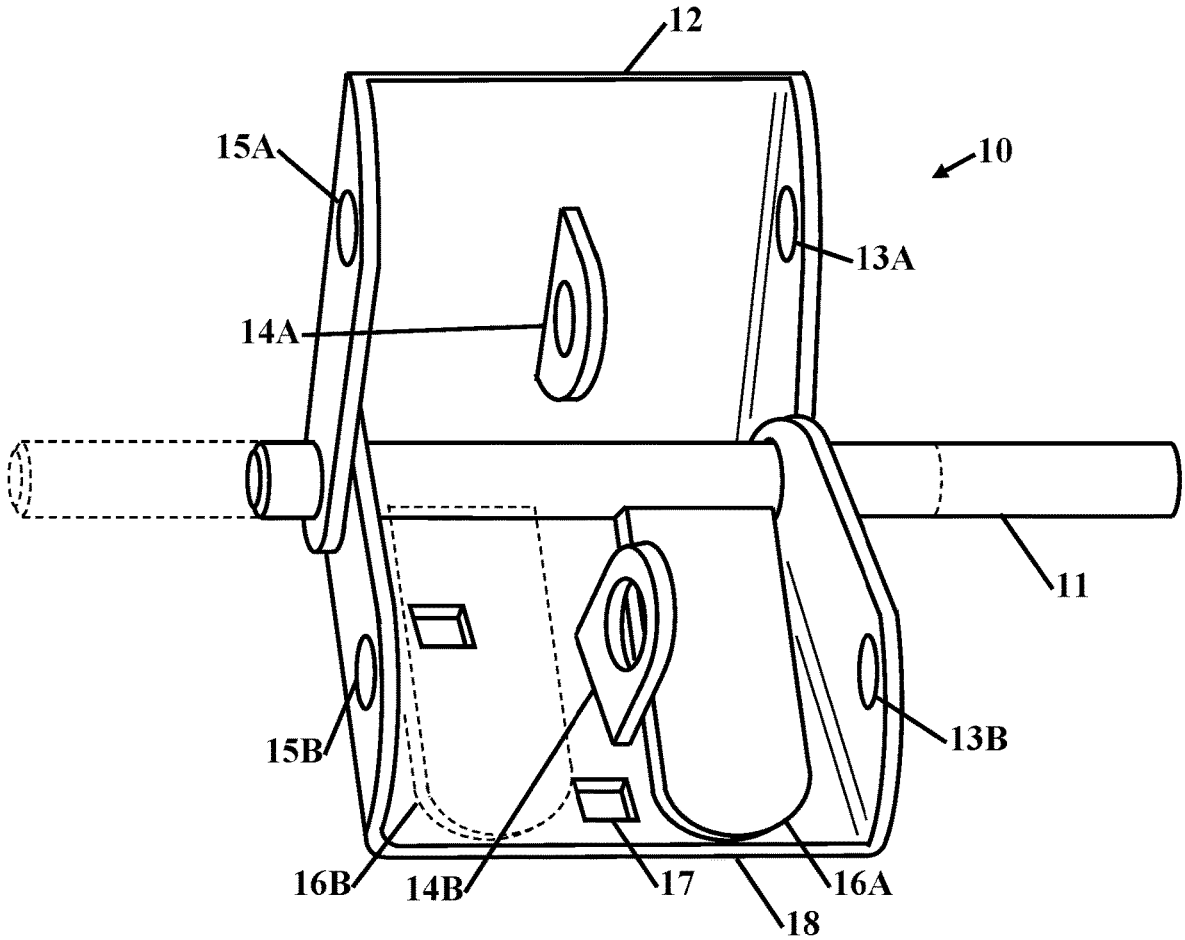
FIG. 1 Prior Art
FIG. 1 shows a prior art hasp.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

10 hasp
11 rod
12 top housing
13A/13B holes
14A/14B locking tab(s)
15A/15B hole(s)
16/16A tongue
17 hole
18 bottom housing
20 hasp
21A/21B rod
22 housing
23A/23B circular holes
24 retainer
25A/25B circular holes
26 tongue
26A/26B position
27 hole
28 housing
29 tab
33A/33B/33C holes
35A/35B/35C holes
40 hole
41A/41B hole(s)
42 support
43B hole
44 vertical bend
46 cover
50 lock
51 face
52 flat
53 tab lock
54 fastener
55 rotated
56 flat
60 slide
61 closed
62 insert FIG. 1 shows a prior art hasp 10. The hasp 10 is constructed with a rod 11 that is connected to a sliding tongue 16. In this figure the tongue 16A is located on the right side of the hasp 10 with the rod 11 protruding out the right side of the top 12 and the bottom 18 housings. The movement locking tabs 14A and 14B divide the top and bottom housings 12 and 18. To move the rod 11 from one side or the other, within the hasp 10, the slide tongue 16 is lifted and passed between the movement locking tabs 14A and 14B. The rod 11 also forms a hinge pin whereby the top and bottom housings 12 and 18 can pivot on the rod 11.

When the top 12 and bottom 18 housings are closed the location of the sliding tongue is held within the right side as 16A or the left side as 16B. The shackle of a lock is placed through the holes 13A/B or 15A/B to hold the hasp 10 closed and prevent movement of the rod 11. The bottom of the hasp 10 has a plurality of square holes 17 for locating a carriage bolt within the hasp 10. In the prior art embodiment, the shackle of a lock maintains the hasp in position.

Figure 2:
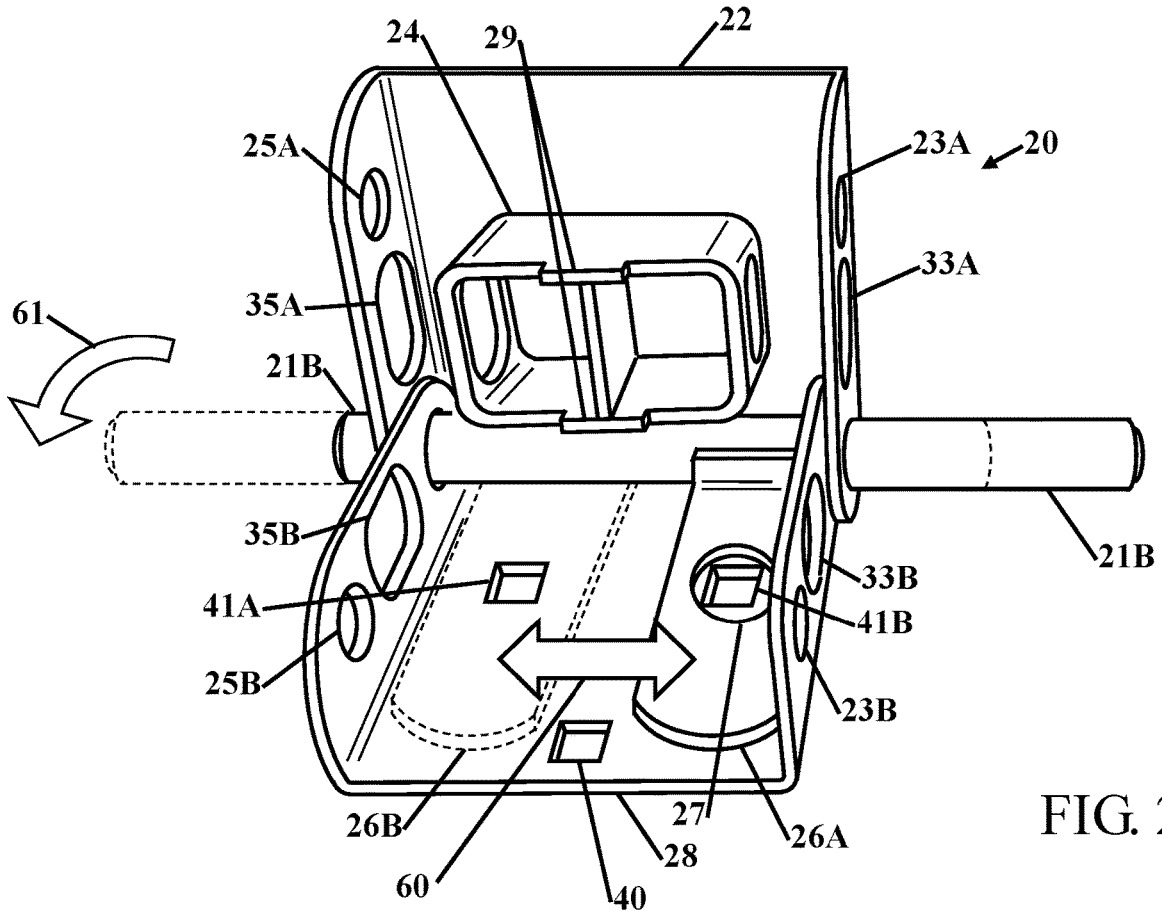
FIG. 2 shows a hasp for a cylindrical lock.
Figure 3:
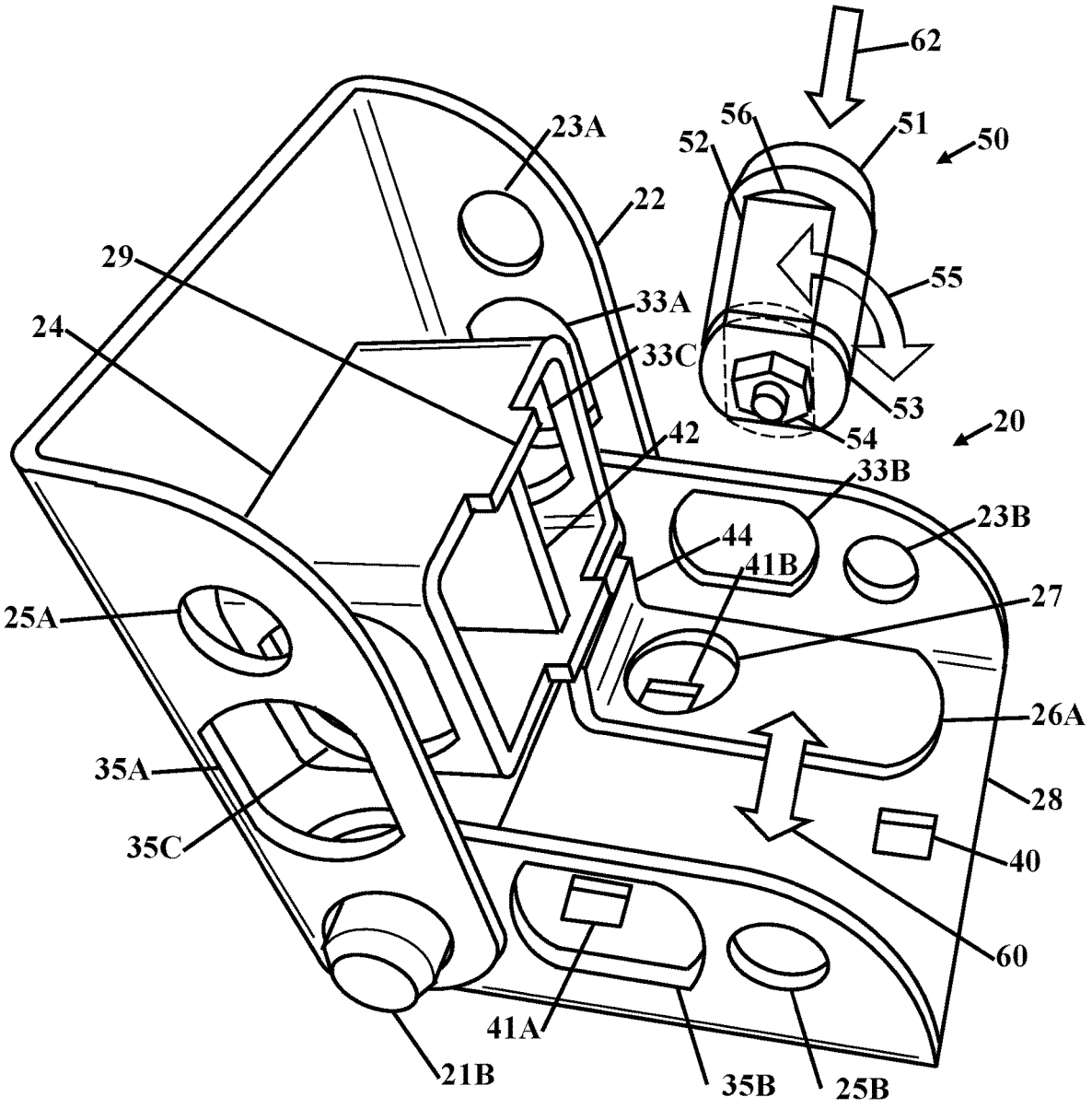
FIG. 3 shows the open hasp with a cylindrical lock.

FIG. 2 shows a hasp 20 for a cylindrical lock and FIG. 3 shows the open hasp 20 with a cylindrical lock. There are a number of structural differences between the embodiment that is shown and the prior art hasp to operate the hasp 20 for a cylindrical lock. This embodiment also (optionally) maintains the circular holes 23A/B and 25A/B to allow a user to use the hasp with a shackle style padlock. The major differences involve:

A) The rounded rectangular holes 33A/B/C that allows the cylindrical lock to be located in the right side of the hasp 20 and rounded rectangular holes 33A/B/C for the cylindrical lock to be located on the left side of the hasp 20.

B) The cylindrical lock retainer 24. The cylindrical lock retainer 24 has rounded rectangular holes 33C and 35C whereby the tab lock 53 is inserted into the hasp 20 to a depth whereby the tab lock 53 is rotated 55 within the respective interior space of the cylindrical lock retainer to maintain the cylindrical lock 50 within the hasp 20.

C) The cylindrical lock retainer 24 has one or a plurality of slide lock tabs 29 that holds the slide tongue 26 in position 26A or 26B. While this embodiment shows two slide lock tabs 29, only one slide lock tab 29 is needed to maintain the slide tongue 26 in either position 26A/B.

D) The slide tongue 26 has a vertical bend 44. The vertical bend maintains the majority of the surface of the slide tongue 26 against or in closer proximity to the bottom housing 28. This provides additional clearance for the cylindrical lock retainer 24 and the cylindrical lock. Due to the lower position of the slide tongue 26 within the hasp 20, the slide tongue 20 has a clearance hole or a fastener hole 27 that allows the head of a carriage bolt (or other fastener) that is inserted into holes 40, 41A, and 41B to protrude into or through the slide tongue 26. The holes 40, 41A and 41B are shown as square holes to prevent rotation of a carriage bolt, but could also be round.

The slide tongue 26 is welded or otherwise secured to the rod 21 at the top portion of the vertical bend 44. When the top 22 housing of the hasp 20 is opened from the bottom 28 housing of the hasp (as shown in these figures) the slide tongue 26 can be easily positioned left or right of the interior of the housing. An additional advantage of this embodiment is that the housings do not require a complete opening to allow movement of the slide tongue 26 and further the slide tongue 26 does not need to be lifted to slide 60 the slide tongue 26 from 26A to 26B. These figures also show an optional vertical support 42 that can be used to increase the structural strength of the cylindrical lock retainer 24. Once the housings 22 and 28 are closed 61 the slide tongue 26 is maintained in position 26A or 26B where it is prevented from movement by slide lock tab 29.

The cylindrical lock 50 has a lock face 51 where a cylindrical key fits into the lock to rotate 55 the tab lock 53. The cylindrical lock 50 has a larger rounded face with a wall or flat 56. The flat 56 engages in the outside of the rounded rectangular hole 33A or 35A depending upon the side where the cylindrical lock 50 is inserted. The flat or wall 56 prevents over insertion of the cylindrical lock 50 into the rounded rectangular holes. It also positions the tab lock 53 within the inside of the cylindrical lock retainer 24.

The flat 52 fits onto the flat sides of the rounded rectangular holes 33A/B/C or 35A/B/C to prevent rotation of the cylindrical lock 50 when it is inserted into holes 33A/B/C or 35A/B/C. This allows a user to rotate 55 the tab lock 53 to lock or unlock the cylindrical lock 50 in the hasp 20. A fastener 54 retains the tab lock 53 on the end of the cylindrical lock 50. When the tab lock 53 is aligned with the flat 52 of the cylindrical lock 50 the cylindrical lock 50 can be easily inserted 62 and removed from the holes 33A/B/C or 35A/B/C of the hasp 20. When the cylindrical lock 50 is properly inserted into the hasp 20, the tab lock 53 is rotated 55 behind the rounded rectangular hole 33C or 35C the cylindrical lock 50 is prevented from removal from the hasp 20 and movement of the slide tongue 26 is prevented to lock the position of the rod 21.

Figure 4:
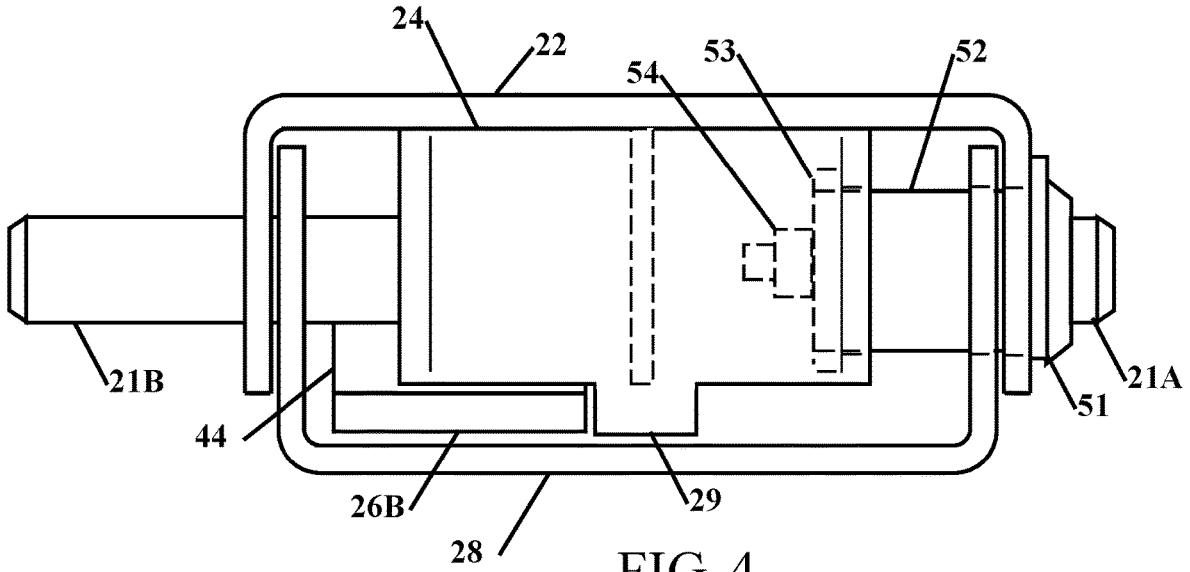
FIG. 4 shows a front view of the hasp with the cylindrical lock inserted.
Figure 5:
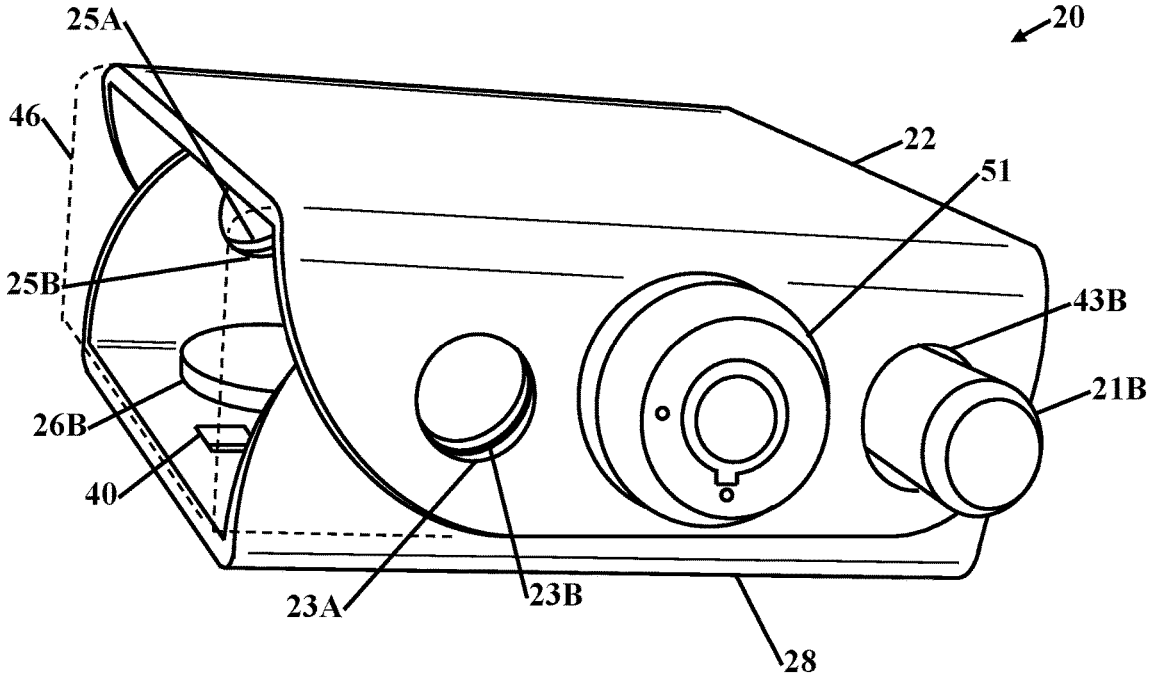
FIG. 5 shows a perspective view of the hasp with the cylindrical lock inserted.

FIG. 4 shows a front view of the hasp with the cylindrical lock inserted and FIG. 5 shows a perspective view of the hasp with the cylindrical lock inserted. In FIG. 4 the slide tongue 26B is shown in the left side of the hasp where it is prevented from movement to the right by the slide lock tab 29. The top 22 and bottom 28 housings are essentially maintained in a parallel relationship when the cylindrical lock in inserted into the hasp. The vertical bend 44 of the slide tongue is shown connecting to the protruding end of rod 21B on the left, with a shorter portion of the rod 21A on the right side of the hasp. The tab lock 53 of the cylindrical lock is shown extending from the flat 52 of the cylindrical lock. This prevents removal of the cylindrical lock. The flat 52 is essentially sandwiched in the hasp between the tab lock 53 and the back of the lock face 51.

The oblique view from FIG. 5 shows the lock and hasp configuration from FIG. 4 where only a portion of the rod 21B is shown extending out of hole 43B. The holes 23A/B and 25A/B are aligned to allow for insertion of one or more shackle lock(s). The shackle lock can be used with the cylindrical lock, instead of the cylindrical lock or in combination where both the shackle lock and cylindrical lock must be removed to open the hasp 20. It is also possible that two cylindrical locks and to shackle locks can be used with the hasp at the same time and thereby requiring all four locks to be removed to move the rod 21B. Typically, only one lock is inserted, and the side where the lock is inserted is based upon access or interference with walls or supports on the sides of the hasp where insertion of a key or removal of the lock is restricted on one side of the hasp but not on the other side of the hasp. One of the fastener holes 40 is shown in this figure, and the fastener would be inserted into the hasp with the head being located internal of the top 22 and bottom 28 housings.

It is contemplated that the holes for the shackle can be removed and the top or bottom housing being configured with a cover 46 that protects the internal features of the hasp and prevents intrusion from insects, tools or tools that can harm the integrity of the hasp.

Thus, specific embodiments of a hasp with cylindrical lock have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A hasp with cylindrical lock comprising:

a top housing and a bottom housing;

said top housing and said bottom housing being hinged on a rod that passes through said top housing and said bottom housing;

said rod having a tongue that is secured thereon;

said tongue and said rod is configured to slide to opposing sides within said top housing and bottom housing with said top housing and said bottom housing are opened;

said hasp further includes a retention mechanism tab that retains said tongue on one side of said top housing and said bottom housing when said top housing is closed on said bottom housing; and said top housing and said bottom housing have aligned rounded rectangular holes that are configured to accept a cylindrical lock to lock said top housing and said bottom housing.

2. The hasp with cylindrical lock according to claim 1, wherein said tongue has a vertical bend that connects to said rod.

3. The hasp with cylindrical lock according to claim 1, further includes aligned holes to accept a shackle lock.

4. The hasp with cylindrical lock according to claim 3, wherein there are said aligned holes that accept a shackle lock on both sides of said top housing and said bottom housing.

5. The hasp with cylindrical lock according to claim 1, wherein said retention mechanism tab is secured to at least one of said top housing and said bottom housing.

6. The hasp with cylindrical lock according to claim 1, wherein said cylindrical lock has a flat that prevents rotation of said cylindrical lock when said cylindrical lock is secured between said top housing and said bottom housing.

7. The hasp with cylindrical lock according to claim 6, wherein said flat engages onto said tongue.

8. The hasp with cylindrical lock according to claim 1, wherein said retention mechanism tab is secured to said top housing.

9. The hasp with cylindrical lock according to claim 8, wherein said retention mechanism tab is configured to prevent side-to-side movement of said tongue when said top housing is closed on said bottom housing.

10. A hasp with cylindrical lock comprising:

a top housing and a bottom housing;

said top housing and said bottom housing being hinged on a rod that passes through said top housing and said bottom housing;

said rod having a tongue that is secured thereon;

said tongue and said rod is configured to slide to opposing sides within said top housing and bottom housing with said top housing and said bottom housing are opened, and said top housing and said bottom housing both have side holes that are configured to accept a body of a cylindrical lock that is passed at least partially between said top housing and said bottom housing to lock said top housing to said bottom housing.

11. The hasp with cylindrical lock according to claim 10, wherein said tongue has a vertical bend that connects to said rod.

12. The hasp with cylindrical lock according to claim 10, further includes aligned holes to accept a shackle lock.

13. The hasp with cylindrical lock according to claim 12, wherein there are said aligned holes that accept a shackle lock on both sides of said top housing and said bottom housing.

14. The hasp with cylindrical lock according to claim 10, further includes a retention mechanism tab that is secured to at least one of said top housing and said bottom housing that retains said tongue on one side of said top housing and said bottom housing when said top housing is closed on said bottom housing.

15. The hasp with cylindrical lock according to claim 10, wherein said cylindrical lock has a flat that prevents rotation of said cylindrical lock when said cylindrical lock is secured between said top housing and said bottom housing.

16. The hasp with cylindrical lock according to claim 15, wherein said flat engages onto said tongue.

17. The hasp with cylindrical lock according to claim 10, wherein said top housing further includes a retainer.

18. The hasp with cylindrical lock according to claim 17, wherein said retainer has at least one slide lock tab.

19. The hasp with cylindrical lock according to claim 18, wherein said at least one slide lock tab prevents side-to-side movement of said tongue when said top housing is closed on said bottom housing.

20. The hasp with cylindrical lock according to claim 14, wherein said retention mechanism tab is configured to prevent side-to-side movement of said tongue when said top housing is closed on said bottom housing.

* * * * *